US011118335B1

(12) United States Patent
Stack et al.

(10) Patent No.: US 11,118,335 B1
(45) Date of Patent: Sep. 14, 2021

(54) ANTI-OVERFLOW TOILET

(71) Applicant: Patrick Gerard Stack, Northville, MI (US)

(72) Inventors: Patrick Gerard Stack, Northville, MI (US); Joan Marie Stoneburner, Commerce Township, MI (US)

(73) Assignee: Patrick Gerard Stack, Northville, MI (US)

( * ) Notice: Subject to any disclaimer, the term of this patent is extended or adjusted under 35 U.S.C. 154(b) by 0 days.

(21) Appl. No.: 17/096,523

(22) Filed: Nov. 12, 2020

(51) Int. Cl.
*E03D 5/02* (2006.01)
*E03D 1/26* (2006.01)

(52) U.S. Cl.
CPC ..... *E03D 5/026* (2013.01); *E03D 1/26* (2013.01)

(58) Field of Classification Search
CPC ..... E03D 1/26; E03D 1/026
USPC ..... 4/427
See application file for complete search history.

(56) References Cited

U.S. PATENT DOCUMENTS 2,075,030 A * 3/1937 Dunean, Jr. ..... E03D 11/18 4/422
2,778,209 A 1/1957 Wilson
3,262,132 A * 7/1966 Mann ..... E03D 11/13 4/427
3,411,162 A 11/1968 Palmer
4,028,747 A 6/1977 Newton
4,204,285 A 5/1980 Pak
5,153,947 A 10/1992 Markles
6,411,162 B2 6/2002 Minamizaki et al.
6,944,892 B1 9/2005 Giolas
7,302,714 B2 12/2007 Orcutt
7,757,312 B2 7/2010 Stack et al.
8,590,068 B2 11/2013 Stack et al.
9,057,187 B2 6/2015 Stack et al.
9,309,659 B2 4/2016 Stack et al.
9,732,506 B2 8/2017 Stack et al.
10,087,611 B2 10/2018 Stack
2004/0231039 A1 11/2004 Turkman
2005/0000005 A1 1/2005 Giesken et al.
2008/0060122 A1 3/2008 Andreiu
2015/0299998 A1* 10/2015 Stack ..... E03D 11/13 4/427
2015/0322660 A1 11/2015 Conrad et al.

* cited by examiner

*Primary Examiner* — Christine J Skubinna
(74) *Attorney, Agent, or Firm* — Quinn IP Law

(57) ABSTRACT

A toilet includes a water storage tank, a bowl including a waste receiving basin that includes an upper rim and at least one toilet bowl aperture in a side wall of the waste receiving basin, a water supply plenum operable to receive water from the water tank and channel the water to the bowl, a primary drain operable to connect the basin and a sewer pipe, and a secondary drain fluidly operable to connect the toilet bowl aperture to the sewer pipe and operable to drain the water from the bowl. The secondary drain is separate from the primary drain and includes an auxiliary aperture fluidly connecting the secondary drain to the water supply plenum and operable to drain the water from the plenum. The toilet bowl aperture and the auxiliary aperture are operable to permit the water to bypass the primary drain when the primary drain is clogged.

9 Claims, 5 Drawing Sheets

3

ANTI-OVERFLOW TOILET

TECHNICAL FIELD

This disclosure relates to an improved bathroom fixture for flushing bodily waste materials into a drainage or sewer system. More particularly, this disclosure includes a toilet having a secondary drainage system that prevents the fixture from overflowing.

SUMMARY

Traditional bathroom fixtures, such as toilets and urinals, may become blocked or plugged-up resulting in the flushing water and waste to overflow when the fixture is flushed. This overflow of water and waste materials is undesirable.

A toilet includes a water storage tank, a bowl including a waste receiving basin that includes an upper rim and at least one toilet bowl aperture in a side wall of the waste receiving basin, a water supply plenum operable to receive water from the water storage tank and channel the water to the bowl, a primary drain connecting the basin and the sewer drainage pipe, and a secondary drain fluidly connecting the toilet bowl aperture to the sewer drainage pipe and operable to drain the water from the bowl. The secondary drain is separate from the primary drain and includes an auxiliary aperture fluidly connecting the secondary drain to the water supply plenum and operable to drain the water from the water supply plenum. The toilet bowl aperture and the auxiliary aperture are operable to permit the water to bypass the primary drain when the primary drain is clogged.

BRIEF DESCRIPTION OF THE DRAWINGS

One or more embodiments will now be described, by way of example, with reference to the accompanying drawings, in which.

DETAILED DESCRIPTION

Figure 1:
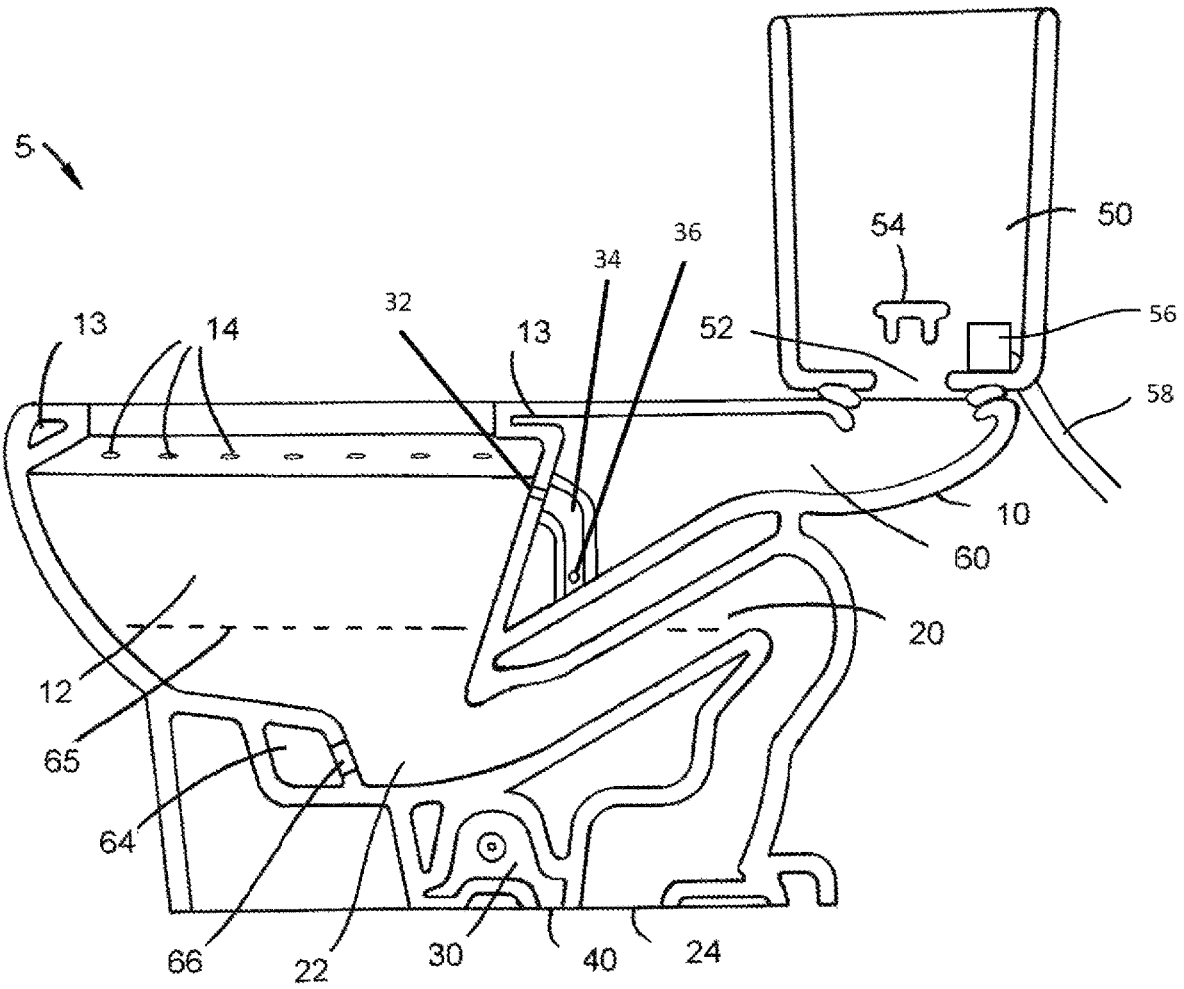
FIG. 1 schematically illustrates an exemplary toilet fixture in side sectional view including a secondary drain, wherein the secondary drain is connected to an aperture in a toilet bowl and includes an auxiliary aperture within a water supply plenum of the toilet fixture, in accordance with the present disclosure.

An anti-overflow toilet configuration is provided including enhanced primary drain bypass flow operable to drain water flow through the toilet which may result from a broken, sheared off, or stuck in a open position water supply fill valve within a water storage tank.

Toilets include a water supply fill valve which selectively provides or cuts off a flow of water from a water supply line connected to the toilet. A water storage tank includes an overflow pipe or overflow channel, such that excess water within the water storage tank flows into the toilet bowl. A stuck open water supply fill valve may cause the toilet to continuously fill at a same rate that occurs after a normal flush. However, when a fill valve is damaged, destroyed, or otherwise broken, an unrestricted flow of water may flow from the water supply line into the toilet. A toilet further includes a primary drain, the passageway at the bottom or base of the toilet bowl through which water and waste flow during a normal operational flush of the toilet. The primary drain is connected to a sewer pipe which leads away from the toilet into a sewer system. An unrestricted flow of water from a broken water supply fill valve may be able to flow through an unclogged primary drain and into the sewer pipe without causing the toilet to overflow. However, in the event of a clogged primary drain, with no way for water to get from the broken water supply fill valve to the sewer pipe, the flow of water through the toilet overflows from the toilet into the surrounding area.

Secondary drains are useful in a toilet to bypass the primary drain and prevent a toilet from overflowing. Secondary drains connect the toilet bowl or other plumbing within the toilet to the sewer pipe with plumbing distinct and separate from the primary drain. In the event of a clog in the primary drain, water may flow through the secondary drain to prevent the water from overflowing from the toilet. A toilet bowl includes a designed water level to which the toilet normally fills after a flush.

In one embodiment, a secondary drain may include one or more apertures in the toilet bowl, for example, above the designed water level for the toilet bowl. In normal operation, the water may never, rarely, or intermittently raise to the level of the apertures in the toilet bowl. When the primary drain of the toilet is clogged, a water level may rise within the toilet bowl to a level at or above the apertures in the toilet bowl. The water may then drain out of the toilet bowl, through the apertures, into the secondary drain, and into the sewer pipe, thereby averting an overflow due to the clogged primary drain. However, water does not begin to drain from the toilet bowl until the water level reaches the apertures in the toilet bowl. With unrestricted flow of water through the toilet resulting from a broken water supply fill valve, by the time the water level reaches the apertures in the toilet bowl, a capacity of the toilet to hold standing water may be substantially filled, thereby reducing a factor of safety for the toilet to drain sufficiently to prevent an overflow. Further, a depth of water that will be present at the apertures in the toilet bowl is limited. Head pressure refers to the pressure that water exerts. Head pressure at the apertures, due to the limited depth of the water above the apertures in the toilet bowl, is limited, and therefore, a flow of water through the apertures in the toilet bowl is limited. For these reasons, apertures in a toilet bowl, by themselves, connected to a secondary drain are unlikely to be able to sufficiently drain a toilet with an unrestricted flow of water resulting from a broken water supply fill valve.

In one embodiment, a toilet may include a water storage tank. The water supply fill valve may be configured to fill the water storage tank to a particular level. When the toilet is flushed, a flapper valve or other similar device may release a water from the water storage tank into a water supply plenum or a passage leading from the water storage tank to the toilet bowl. In one embodiment, the water supply plenum may include passages leading from the water storage tank to water supply aperture located around a perimeter of an underside of a toilet bowl rim. In another embodiment, the water supply plenum may include a water supply jet outlet located at a bottom of the toilet bowl and operable to supply a jet of water during a flush into the primary drain.

In one embodiment, one or more apertures may be provided within the water supply plenum. A secondary drain may be connected to the apertures in the water supply plenum. When a primary drain is clogged and water backs up within a toilet bowl, water may similarly back up within the water supply plenum, for example, equalizing with a water level in the bowl through the water supply jet opening and/or flowing backward through the water supply apertures around the perimeter of the toilet bowl rim. Water may be drained from the toilet through apertures in the water supply plenum and a connected secondary drain into the sewer pipe. Depending upon placement and geometry of the aperture in the water supply plenum, water may flow or divert through the secondary drain during normal operation of the toilet, potentially reducing an overall effectiveness of the normal flushing of the toilet.

Airlock or vapor lock is a condition where flow of a liquid through a pipe or other vessel is slowed or stopped by presence of an air pocket within the pipe. An airlock condition may clear over time, with water flow pushing bubbles of air out of the pipe, but the airlock may for some period of time slow or cease water flow through a pipe. A delay or interference of water flow through a secondary drain may cause or contribute to water overflowing from a toilet. Air tends to raise to a top or highest vertical position within a pipe. An aperture may be placed in an uppermost position within a pipe to enable air to be pushed out of the pipe and thereby quickly release an airlock condition.

A water supply plenum may connect a water storage tank to a water supply jet opening. In some embodiments, the water supply plenum may include a water pathway transiting around and formed integrally with one outer side of the toilet bowl. When water is flowing through the toilet from a broken water supply fill valve as an unrestricted flow of water, increasing a capacity of the secondary drain and internal plumbing of the toilet to bypass the primary drain may be advantageous to avoid overflow. In one embodiment, in order to maximize a water flow from the toilet bowl to an opening of a secondary drain within the water supply plenum, the water supply plenum may include two water pathways connecting in parallel to the water supply jet opening.

A toilet bowl may include a plurality of apertures connected to a secondary drain. The secondary drain may include a pipe, passageway, or hollow portion within and transiting water through the water supply plenum. The secondary drain may lead to a portion of the toilet that connects with the sewer pipe and may include an outlet leading into the sewer pipe separate and distinct from an outlet from the primary drain leading into the sewer pipe. In a portion of the secondary drain that is within the secondary drain plenum, the secondary drain may include an auxiliary aperture permitting water within the water supply plenum to enter the secondary drain. In this way, water may from both the toilet bowl through the apertures in the toilet bowl into the secondary drain and the water supply plenum through the auxiliary aperture into the secondary drain.

Referring now to the drawings, wherein the showings are for the purpose of illustrating certain exemplary embodiments and not for the purpose of limiting the same, FIG. 1 schematically illustrates an exemplary toilet fixture in side sectional view including a secondary drain, wherein the secondary drain is connected to an aperture in a toilet bowl and includes an auxiliary aperture within a water supply plenum of the toilet fixture. Configuration 5 includes fixture 10 with a water storage tank 50, a toilet bowl 12, and a primary drain 20. Water is held in the water storage tank 50 by tank valve 54. Once the tank valve 54 is opened, water rushes according to the pull of gravity through tank aperture 52 and enters the water supply plenum 60 of the fixture 10. Water supply plenum 60 is a closed fluid connection and fluidly connects water storage tank 50 with toilet bowl 12. In another embodiment, a flushometer-type valve may be used with a tank-less toilet, wherein depression of the flushometer-type valve causes a surge of water to enter the water supply plenum 60. A wide variety of toilet designs are envisioned for use with the configurations disclosed herein, and the disclosure is not intended to be limited by the particular examples provided. The water storage tank 50 may include a water supply fill valve 56 connected to a water supply line 58 to provide a selective flow of water into the water storage tank 50. The water supply plenum 60 receives the flow of water from the water storage tank 50 and channels the water flow to different destinations for the purpose of flushing the fixture, emptying contents of the bowl, and refilling the bowl after the flush. A portion of the water flow within the water supply plenum 60 is channeled to a channel 13 circumventing the rim of the toilet bowl 12. Water within the channel 13 flows through apertures 14 and into the toilet bowl 12. A portion of the water flow within the water supply plenum 60 is channeled through a passage which progresses around the bowl and fluidly connects with the jet channel 64. Water exits the jet channel 64 through the water jet aperture 66 to provide flushing action/head pressure to the primary drain 20 at a primary drain inlet 22. Water and waste from the toilet bowl 12 and water from jet channel 64 enter the primary drain 20 and flush through the primary drain 20 as the column of water and waste create a siphon in accordance with operation of a fixture as is known in the art. The water and waste exit the fixture through a primary drain outlet 24. The primary drain outlet 24 is coupled to a structure sewage pipe channeling the waste to other sewage pipes and subsequently out of the structure.

A secondary drain 34 is illustrated within the water supply plenum 60. The secondary drain 34 includes toilet bowl apertures 32 operable to drain water from the toilet bowl 12 if water rises within toilet bowl 12 to the level of the toilet bowl apertures 32. The primary drain 20 and the toilet bowl 12 are configured such that during normal operation, water fills in the toilet bowl 12 until a corresponding operational fill water level 65 within the primary drain 20 causes water filling fixture to overflow the bend in primary drain 20. In this way, a normal water level for the bowl 12 to achieve during a filling cycle of the fixture is set at the operational fill water level 65. When the primary drain 20 clogs, water entering the toilet bowl 12 through the water supply plenum rises, and if this rise in the water level is unchecked, the water may overflow the toilet bowl 12. The toilet bowl apertures 32 prevent such an overflow by permitting water to bypass the primary drain 20 through the secondary drain 34. Additionally, an auxiliary aperture 36 may be formed in the secondary drain 34 within the water supply plenum 60, such that water filling the water supply plenum 60 over the operational fill water level 65 may additionally bypass the primary drain 20.

Because the operational fill water level 65 also defines a water level within water supply plenum 60, it is noted that any auxiliary aperture 36 of the secondary drain 34 may be located above the bend in primary drain 20 and above the operational fill water level 65 such that water will not drain from the water supply plenum 60 through the secondary drain when the bowl is filled to a normal designed level. However, the auxiliary aperture 36 may be located within some threshold distance from water level 65 so as to begin draining the water supply plenum 60 as soon as water rises above the operational fill water level 65. In this way, the secondary drain has an enhanced ability to keep the water from overflowing the toilet bowl 12.

The secondary drain 34 is fluidly connected to the secondary drain channel 30. A passage may be formed integrally within the fixture 10 to connect the secondary drain 34 and the secondary drain channel 30. A passage connecting the secondary drain 34 and the secondary drain channel 30 may include a water trap according to plumbing methods known in the art. Water within secondary drain channel 30 may exit the fixture through the secondary drain outlet 40. In another embodiment, the secondary drain channel 30 may be configured to empty into the primary drain 20 just above the primary drain outlet 24. The primary drain outlet 24 and the secondary drain outlet 40 may be configured to connect to a standard plumbing connection known in the art. In such an embodiment, secondary drain outlet 40 may be configured to extend through a collar region of the fixture and discharge water directly into the standard plumbing connection. Water may be channeled from the water supply plenum 60 into secondary drain 34 through the auxiliary aperture 36 for the purpose of flushing the secondary drain and cleaning it out.

If a clog in the primary drain 20 prevents water and waste from exiting the toilet bowl 12, the water level in the toilet bowl 12 rises and eventually flows through the toilet bowl apertures 32. As the water level in the toilet bowl 12 rises, a water level within the water supply plenum 60 will also rise. Water from the toilet bowl apertures 32 and from the auxiliary aperture 36 flows to the secondary drain channel 30, and flows out of the secondary drain outlet 40. By flowing through the secondary drain, water bypasses the clog in the primary drain 20 and prevents the fixture from overflowing out of the bowl. By sizing the toilet bowl apertures 32, the auxiliary aperture 36, and the secondary drain 34 adequately, a broken water supply fill valve 56 may be accounted for, with an unrestricted flow of water from the water supply line 58 being channeled through the secondary drain without the toilet overflowing.

More than one secondary drain 34 and/or more than one auxiliary aperture 36 may be used to channel water from the water supply plenum 60.

Secondary drain apertures such as the toilet bowl apertures 32 and the auxiliary aperture 36 may be formed integrally with the wall during the process of constructing the fixture, for example, prior to the porcelain material being heated, or the secondary drain apertures may be added to the walls of the fixture through a drilling process after the construction of the fixture.

The embodiment of FIG. 1 includes the jet channel 64. Some toilet fixtures include a water jet channel and some do not. A secondary drain inlet within a water supply plenum may still work within a fixture wherein water enters the bowl through apertures around the rim. However, water from the rising level in the bowl will not enter the plenum until the water level exceeds the height of the apertures around the rim. In such an exemplary configuration, larger apertures around the rim and/or a portion of apertures around the rim placed lower in the bowl could facilitate water flowing from a bowl back into the plenum before the water level gets too high in the bowl.

Figure 2:
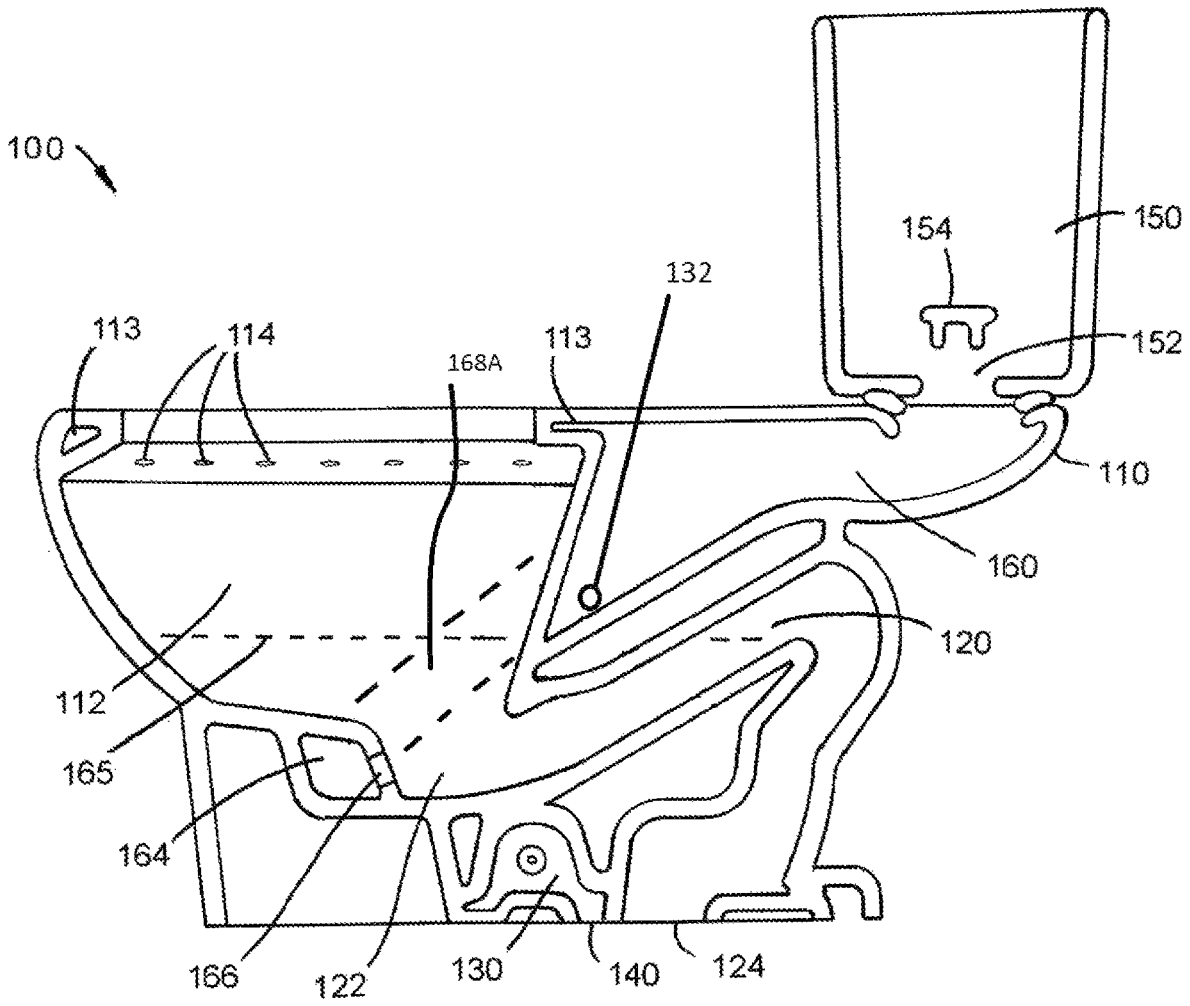
FIG. 2 schematically illustrates an alternative exemplary toilet fixture in side sectional view including a water supply plenum including two water pathways connecting in parallel to the water supply jet opening, in accordance with the present disclosure.

FIG. 2 schematically illustrates an alternative exemplary toilet fixture in side sectional view including a water supply plenum including two water pathways connecting in parallel to the water supply jet opening. Configuration 100 includes fixture 110 with a water storage tank 150, a toilet bowl 112, and a primary drain 120. Water is held in the water storage tank 150 by tank valve 154. Once the tank valve 154 is opened, water rushes according to the pull of gravity through tank aperture 152 and enters the water supply plenum 160 of the fixture 110. The water supply plenum 160 receives the flow of water from the water storage tank 150 and channels the water flow to different destinations for the purpose of flushing the fixture, emptying contents of the bowl, and refilling the bowl after the flush. A portion of the water flow within the water supply plenum 160 is channeled to a channel 113 circumventing the rim of the toilet bowl 112. Water within the channel 113 flows through apertures 114 and into the toilet bowl 112. A portion of the water flow within the water supply plenum 160 is channeled through at least one water pathway 168A which progresses around the bowl and fluidly connects with the jet channel 164. Water exits the jet channel 164 through the water jet aperture 166 to provide flushing action/head pressure to the primary drain 120 at a primary drain inlet 122. Water and waste from the toilet bowl 112 and water from jet channel 164 enter the primary drain 120 and flush through the primary drain 120 as the column of water and waste create a siphon in accordance with operation of a fixture as is known in the art. The water and waste exit the fixture through a primary drain outlet 124. The primary drain outlet 124 is coupled to a structure sewage pipe channeling the waste to other sewage pipes and subsequently out of the structure.

A secondary drain aperture 132 is illustrated within the water supply plenum 160. The primary drain 120 and the toilet bowl 112 are configured such that, during normal operation, water fills in the toilet bowl 112 until a corresponding operational fill water level 165 within the primary drain 120 causes water filling fixture to overflow the bend in primary drain 120. In this way, a normal water level for the bowl 112 to achieve during a filling cycle of the fixture is set at the operational fill water level 165. Because the operational fill water level 165 also defines a water level within water supply plenum 160, it is noted that any secondary drain aperture 132 may be located above the bend in primary drain 120 and above the operational fill water level 165 such that water will not drain from the water supply plenum 160 through the secondary drain when the bowl is filled to a normal designed level. However, the secondary drain aperture 132 may be located within some threshold distance from water level 165 so as to begin draining the water supply plenum 60 as soon as water rises above the operational fill water level 165. In this way, the secondary drain has an enhanced ability to keep the water from overflowing the toilet bowl 112.

The secondary drain aperture 132 is fluidly connected to the secondary drain channel 130 by a secondary drain passage. The passage of the secondary drain may be formed integrally within the fixture 110 to connect the secondary drain aperture 132 and the secondary drain channel 130. The passage connecting the secondary drain aperture 132 and the secondary drain channel 130 may include a water trap according to plumbing methods known in the art. Water within secondary drain channel 130 may exit the fixture through the secondary drain outlet 140. In another embodiment, the secondary drain channel 130 may be configured to empty into the primary drain 120 just above the primary drain outlet 124. The primary drain outlet 124 and the secondary drain outlet 140 may be configured to connect to a standard plumbing connection known in the art. In such an embodiment, secondary drain outlet 140 may be configured to extend through a collar region of the fixture and discharge water directly into the standard plumbing connection. Water may be channeled from the water supply plenum 160 into secondary drain aperture 132 through the auxiliary aperture 36 for the purpose of flushing the secondary drain and cleaning it out.

If a clog in the primary drain 120 prevents water and waste from exiting the toilet bowl 112, the water level in the toilet bowl 112 rises. As the water level in the toilet bowl 112 rises, a water level within the water supply plenum 160 will also rise. As the water level within the plenum reaches and enters the secondary drain aperture 132, water flows to the secondary drain channel 130 and flows out of the secondary drain outlet 140. By flowing through the secondary drain, water from the water supply plenum 160 bypasses the clog in the primary drain 120 and prevents the fixture from overflowing out of the bowl.

More than one secondary drain aperture 132 may be used to channel water from the water supply plenum 160.

Secondary drain apertures such as the secondary drain aperture 132 may be formed integrally with the wall during the process of constructing the fixture, for example, prior to the porcelain material being heated, or the secondary drain apertures may be added to the walls of the fixture through a drilling process after the construction of the fixture.

Figure 3:
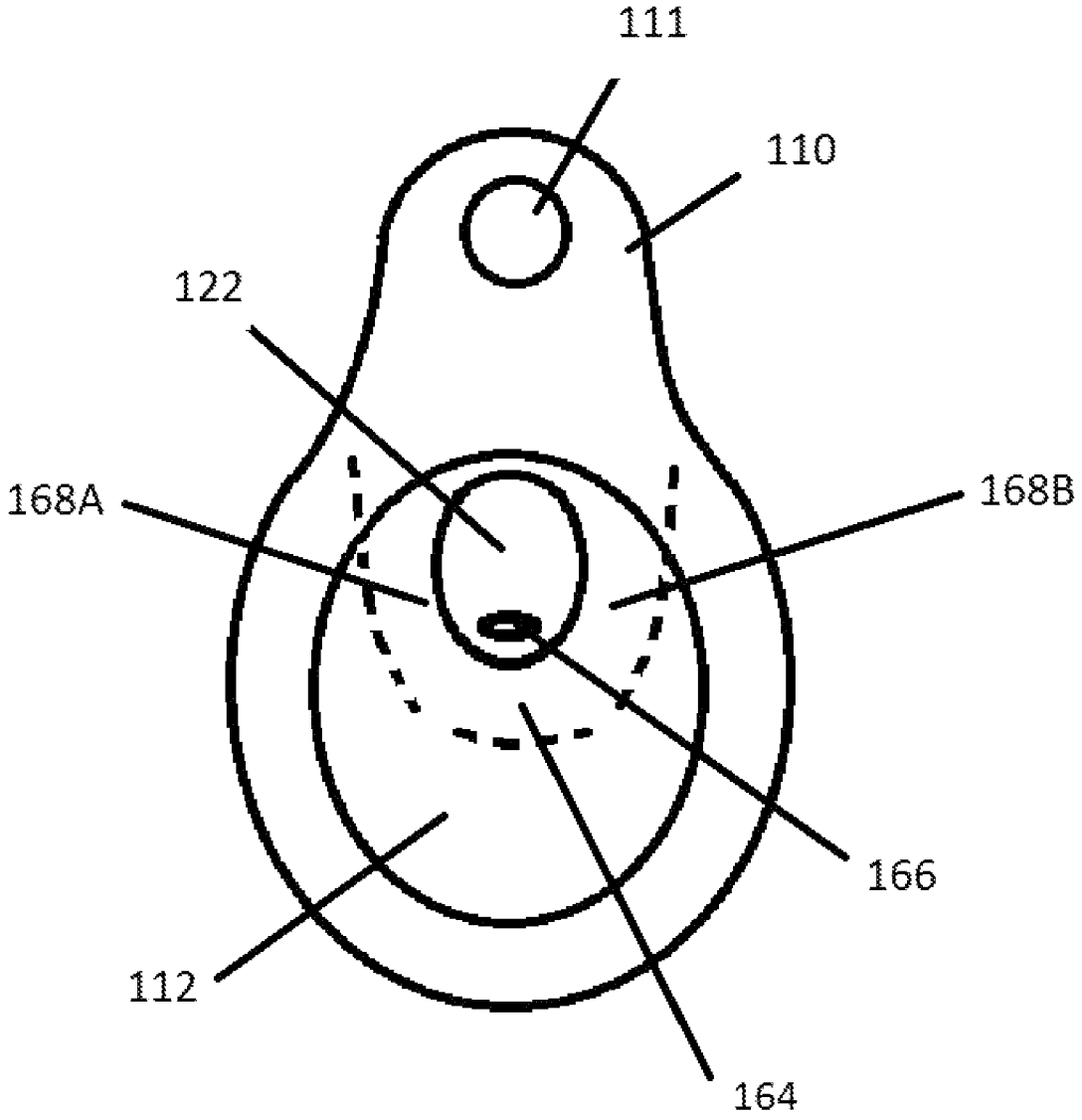
FIG. 3 schematically illustrates the toilet fixture of FIG. 2 in top view, illustrating the two water pathways extending around a first side of a toilet bowl of the toilet fixture and around a second side of the toilet bowl, in accordance with the present disclosure.

FIG. 3 schematically illustrates the toilet fixture of FIG. 2 in top view, illustrating the two water pathways extending around a first side of a toilet bowl of the toilet fixture and around a second side of the toilet bowl. Fixture 110 is illustrated including tank an interface aperture 111, a toilet bowl 112, a primary drain inlet 122, a water jet channel 164, and a water jet aperture 166. Dotted lines illustrate a first water pathway, the water pathway 168A, and a second water pathway, the water pathway 168B, each connecting a water supply plenum within fixture 110 to the water jet channel 164 and the water jet aperture 166. While toilets may include a single water pathway 168A connecting water supply plenum 160 to jet channel 164 through the water jet aperture 166, more than one water pathway may be advantageously utilized. For example, in the event of a water supply fill valve failure, the water pathway 168A and a water pathway 168B may be utilized in parallel to increase an amount of water that may flow from toilet bowl 112 to water supply plenum 160 in the event that the primary drain 120 is clogged. Water channeled through the water pathway 168A and the water pathway 168B into the water supply plenum 160 may be drained out of the water supply plenum 160 through an auxiliary aperture in a secondary drain.

Figure 4:
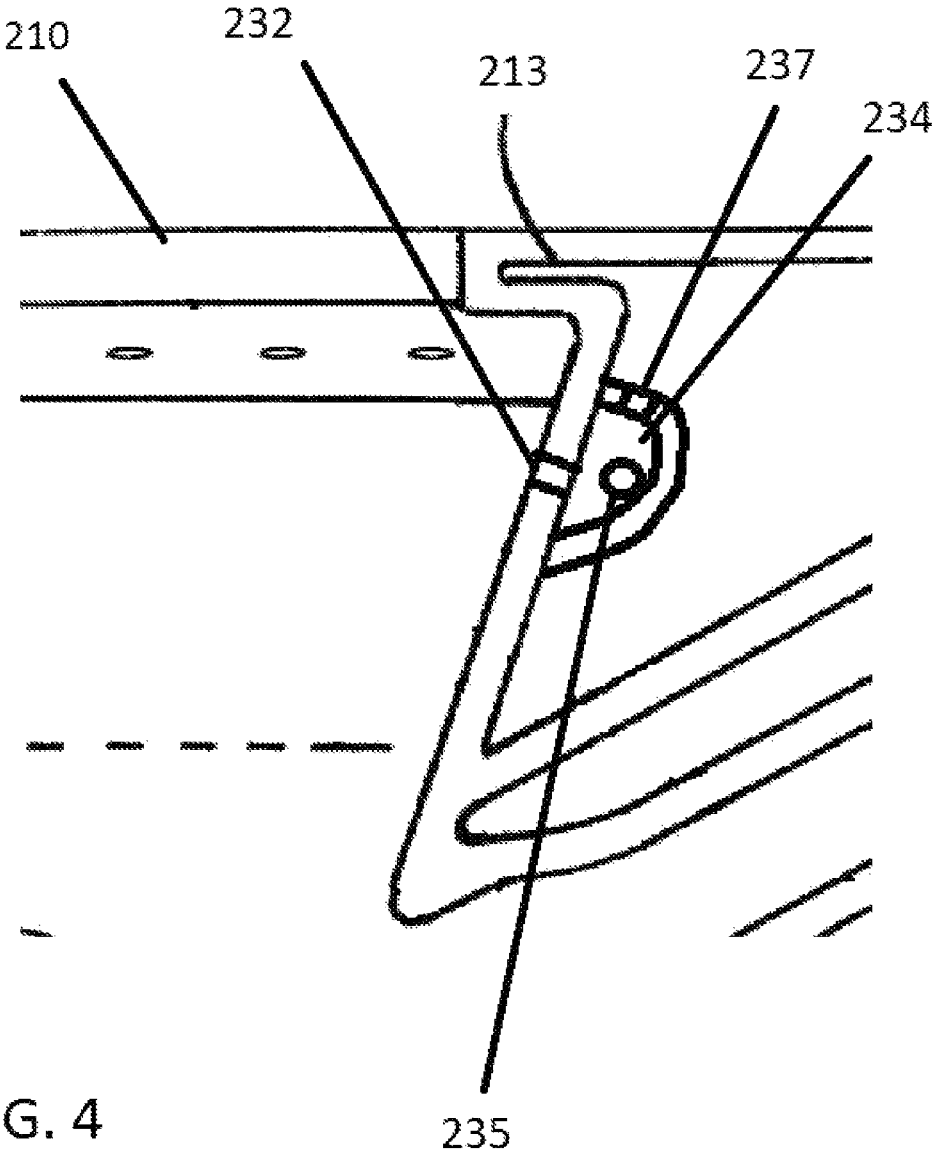
FIG. 4 schematically illustrates an alternative exemplary toilet fixture in side sectional view including a secondary drain including an airlock relief aperture at an upper point of the secondary drain, in accordance with the present disclosure.

FIG. 4 schematically illustrates an alternative exemplary toilet fixture in side sectional view including a secondary drain including an airlock relief aperture at an upper point of the secondary drain. Fixture 210 is illustrated and is similar to the fixture 10 of FIG. 1. FIG. 4 includes a magnified view of a toilet bowl of the fixture 210, including one or more toilet bowl apertures 232. A portion of the water flow within the water supply plenum is channeled to a channel 213 circumventing the rim of the toilet bowl. A secondary drain cavity 234 is illustrated within a water supply plenum including the secondary drain 235 which connects with a secondary drain outlet. When a primary drain of the toilet is clogged, water may back up within the toilet bowl, and water may flow through the toilet bowl apertures 232 into the secondary drain cavity 234 and subsequently into the secondary drain 235.

An airlock condition may occur, wherein water within the secondary drain cavity may fail to quickly drain through the secondary drain 235 due to air trapped within the secondary drain cavity 234. An airlock relief aperture 237 is illustrated at a top of the secondary drain cavity 234 or at a top of the secondary drain 235. Because air rises within a column of water, by placing the airlock relief aperture 237 at or near a top of the secondary drain 235, an airlock condition within the secondary drain may be avoided and flow through the secondary drain 235 during a clogged primary drain event may be maximized. When water flows through the toilet bowl apertures 232 into the secondary drain cavity 234, the water may force air from the secondary drain cavity 234 through the airlock relief aperture 237, thereby preventing an airlock condition within the secondary drain.

Figure 5:
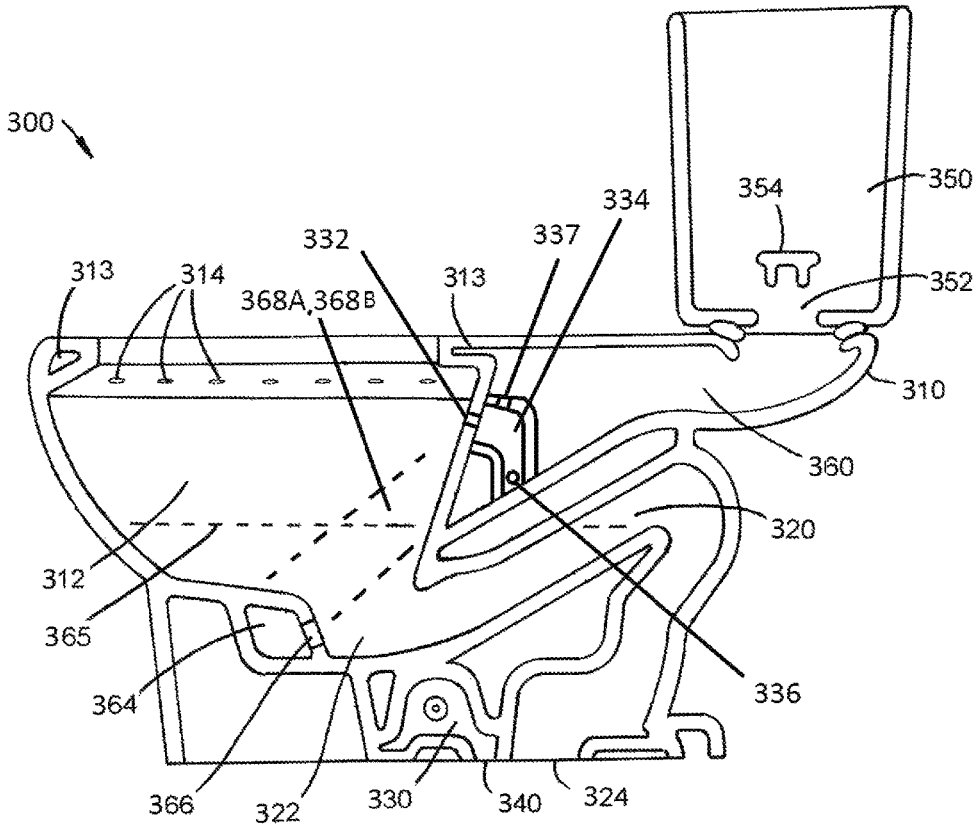
FIG. 5 schematically illustrates an alternative exemplary toilet fixture in side sectional view, including a secondary drain, wherein the secondary drain is connected to an aperture in a toilet bowl and includes an auxiliary aperture within a water supply plenum of the toilet fixture, further including a water supply plenum including two water pathways connecting in parallel to the water supply jet opening, and further including the secondary drain including an airlock relief aperture at an upper point of the secondary drain, in accordance with the present disclosure.

FIG. 5 schematically illustrates an alternative exemplary toilet fixture in side sectional view, including a secondary drain, wherein the secondary drain is connected to an aperture in a toilet bowl and includes an auxiliary aperture within a water supply plenum of the toilet fixture, further including a water supply plenum including two water pathways connecting in parallel to the water supply jet opening, and further including the secondary drain including an airlock relief aperture at an upper point of the secondary drain.

Configuration 300 includes fixture 310 with a water storage tank 350, a toilet bowl 312, and a primary drain 320. Water is held in the water storage tank 350 by tank valve 354. Once the tank valve 354 is opened, water rushes according to the pull of gravity through tank aperture 352 and enters the water supply plenum 360 of the fixture 310. The water supply plenum 360 receives the flow of water from the water storage tank 350 and channels the water flow to different destinations for the purpose of flushing the fixture, emptying contents of the bowl, and refilling the bowl after the flush. A portion of the water flow within the water supply plenum 360 is channeled to a channel 313 circumventing the rim of the toilet bowl 312. Water within the channel 313 flows through apertures 314 and into the toilet bowl 312. A portion of the water flow within the water supply plenum 360 is channeled through a passage which progresses around the bowl and fluidly connects with the jet channel 364. Water exits the jet channel 364 through the water jet aperture 366 to provide flushing action/head pressure to the primary drain 320 at a primary drain inlet 322. Water and waste from the toilet bowl 312 and water from jet channel 364 enter the primary drain 320 and flush through the primary drain 320 as the column of water and waste create a siphon in accordance with operation of a fixture as is known in the art. The water and waste exit the fixture through a primary drain outlet 324. The primary drain outlet 324 is coupled to a structure sewage pipe channeling the waste to other sewage pipes and subsequently out of the structure.

A secondary drain 334 is illustrated within the water supply plenum 360. The primary drain 320 and the toilet bowl 312 are configured such that during normal operation, water fills in the toilet bowl 312 until a corresponding operational fill water level 365 within the primary drain 320 causes water filling fixture to overflow the bend in primary drain 320. In this way, a normal water level for the bowl 312 to achieve during a filling cycle of the fixture is set at the operational fill water level 365. Because the operational fill water level 365 also defines a water level within water supply plenum 360, it is noted that any auxiliary aperture 336 of the secondary drain 334 may be located above the bend in primary drain 320 and above the operational fill water level 365 such that water will not drain from the water supply plenum 360 through the secondary drain when the bowl is filled to a normal designed level. However, the auxiliary aperture 336 may be located within some threshold distance from water level 365 so as to begin draining the water supply plenum 360 as soon as water rises above the operational fill water level 365. In this way, the secondary drain has an enhanced ability to keep the water from overflowing the toilet bowl 312.

The secondary drain 334 is fluidly connected to the secondary drain channel 330. A channel may be formed integrally within the fixture 310 to connect the secondary drain 334 and the secondary drain channel 330. A channel connecting the secondary drain 334 and the secondary drain channel 330 may include a water trap according to plumbing methods known in the art. Water within secondary drain channel 330 may exit the fixture through the secondary drain outlet 340. In another embodiment, the secondary drain channel 330 may be configured to empty into the primary drain 320 just above the primary drain outlet 324. The primary drain outlet 324 and the secondary drain outlet 340 may be configured to connect to a standard plumbing connection known in the art. In such an embodiment, secondary drain outlet 340 may be configured to extend through a collar region of the fixture and discharge water directly into the standard plumbing connection. Water may be channeled from the water supply plenum 360 into secondary drain 334 through the auxiliary aperture 336 for the purpose of flushing the secondary drain and cleaning it out.

If a clog in the primary drain 320 prevents water and waste from exiting the toilet bowl 312, the water level in the toilet bowl 312 rises. As the water level in the toilet bowl 312 rises, a water level within the water supply plenum 360 will also rise. As the water level within the plenum reaches and enters the auxiliary aperture 336 of secondary drain 334, flows to the secondary drain channel 330, and flows out of the secondary drain outlet 340. By flowing through the secondary drain, water from the water supply plenum 360 bypasses the clog in the primary drain 320 and prevents the fixture from overflowing out of the bowl.

More than one secondary drain 334 and/or more than one auxiliary aperture 336 may be used to channel water from the water supply plenum 360.

Secondary drain apertures such as the toilet bowl apertures 332 and the auxiliary aperture 336 may be formed integrally with the wall during the process of constructing the fixture, for example, prior to the porcelain material being heated, or the secondary drain apertures may be added to the walls of the fixture through a drilling process after the construction of the fixture.

The secondary drain 334 includes an airlock relief aperture 337 at a top of the secondary drain 334. Additionally, dotted lines illustrate a first water pathway, the water pathway 368A, and a second water pathway, the water pathway 368B, each connecting the water supply plenum 360 to the water jet channel 364 and the water jet aperture 366. Taken in combination, the toilet bowl apertures 332, the secondary drain 334, the auxiliary aperture 336, the airlock relief aperture 337, and the plurality of water pathways, including the water pathway 368A and the water pathway 368B, connecting the water supply plenum 360 and the water jet aperture 366 collectively improve an ability and capacity of configuration 300 to enable water to bypass a clogged primary drain 320 and channel water through the secondary drain outlet 340.

The sewer pipe or the collar for the sewer pipe may be installed with the end of the sewer pipe or the collar thereof presenting a flat or substantially flat surface with the opening in a horizontal planar orientation for a toilet fixture to be installed thereto, with a wax ring typically being compressed between the fixture and sewer pipe. The primary drain of embodiments herein includes an outlet which may extend past a top surface or an opening of the sewer pipe such that liquids leaving the primary drain empty directly into the sewer pipe. Similarly, the secondary drain includes an outlet which may extend past a top surface or opening of the sewer pipe. The primary drain outlet and secondary drain outlet may be entirely separate tubes extending into the sewer line. In another example, for example, when the primary drain and secondary drain are unitarily formed, the primary drain outlet and the secondary drain outlet each may empty separately into the sewer pipe, however with a dividing wall separating the primary drain outlet and the secondary drain outlet not necessarily extending past the entrance to the sewer pipe.

Apertures described herein may be alternatively as short channels or apertures in a wall of a toilet fixture.

The disclosure has described certain embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A toilet configuration that is connectable to a sewer drainage pipe, the toilet configuration comprising:

a water storage tank;

a toilet bowl including a waste receiving basin that includes an upper rim and at least one toilet bowl aperture in a side wall of the waste receiving basin;

a water supply plenum operable to receive water from the water storage tank and channel the water to the toilet bowl;

a primary drain operable to fluidly connect the waste receiving basin and the sewer drainage pipe; and a secondary drain operable to fluidly connect the toilet bowl aperture to the sewer drainage pipe and operable to drain the water from the toilet bowl into the sewer drainage pipe, wherein the secondary drain is separate from the primary drain and includes an auxiliary aperture located vertically below the at least one toilet bowl aperture and fluidly connecting the secondary drain to the water supply plenum, wherein the auxiliary aperture is operable to drain the water from the water supply plenum into the sewer drainage pipe; and wherein the toilet bowl aperture and the auxiliary aperture are operable to permit the water to bypass the primary drain when the primary drain is clogged.

2. The toilet configuration of claim 1, wherein the secondary drain further includes an airlock relief aperture including an aperture fluidly connecting the secondary drain to the water supply plenum.

3. The toilet configuration of claim 2, wherein the airlock relief aperture is at a top of the secondary drain.

4. The toilet configuration of claim 1, further comprising a water supply jet outlet operable to receive the water channeled by the water supply plenum and direct the water into the waste receiving basin; and wherein the water supply plenum includes two water pathways connecting the water supply plenum to the water supply jet outlet, the two water pathways including a first water pathway extending around a first side of the toilet bowl and a second water pathway extending around a second side of the toilet bowl.

5. A toilet configuration that is connectable to a sewer drainage pipe, the toilet configuration comprising:

a water storage tank;

a toilet bowl including a waste receiving basin that includes an upper rim and at least one toilet bowl aperture in a side wall of the waste receiving basin;

a water supply plenum operable to receive water from the water storage tank and channel the water to the toilet bowl;

a primary drain operable to fluidly connect the waste receiving basin and the sewer drainage pipe; and a secondary drain operable to fluidly connect the toilet bowl aperture to the sewer drainage pipe and operable to drain the water from the toilet bowl into the sewer drainage pipe, wherein the secondary drain is separate from the primary drain and includes:

an auxiliary aperture located vertically below the at least one toilet bowl aperture and fluidly connecting the secondary drain to the water supply plenum, wherein the auxiliary aperture is operable to drain the water from the water supply plenum into the sewer drainage pipe; and an airlock relief aperture including an aperture fluidly connecting the secondary drain to the water supply plenum; and wherein the toilet bowl aperture and the auxiliary aperture are operable to permit the water to bypass the primary drain when the primary drain is clogged.

6. The toilet configuration of claim 5, wherein the airlock relief aperture is at a top of the secondary drain.

7. The toilet configuration of claim 5, further comprising a water supply jet outlet operable to receive the water channeled by the water supply plenum and direct the water into the waste receiving basin; and wherein the water supply plenum includes two water pathways connecting the water supply plenum to the water supply jet outlet, the two water pathways including a first water pathway extending around a first side of the toilet bowl and a second water pathway extending around a second side of the toilet bowl.

8. A toilet configuration that is connectable to a sewer drainage pipe, the toilet configuration comprising:

a water storage tank;

a toilet bowl including a waste receiving basin that includes an upper rim and at least one toilet bowl aperture in a side wall of the waste receiving basin;

a water supply plenum operable to receive water from the water storage tank and channel the water to the toilet bowl;

a primary drain operable to fluidly connect the waste receiving basin and the sewer drainage pipe;

a secondary drain operable to fluidly connect the toilet bowl aperture to the sewer drainage pipe and operable to drain the water from the toilet bowl into the sewer drainage pipe, wherein the secondary drain is separate from the primary drain and includes:

an auxiliary aperture located vertically below the at least one toilet bowl aperture and fluidly connecting the secondary drain to the water supply plenum, wherein the auxiliary aperture is operable to drain the water from the water supply plenum into the sewer drainage pipe; and an airlock relief aperture including an aperture at a top of the secondary drain fluidly connecting the secondary drain to the water supply plenum; and a water supply jet outlet operable to receive the water channeled by the water supply plenum and direct the water into the waste receiving basin and wherein the water supply plenum includes two water pathways connecting the water supply plenum to the water supply jet outlet, the two water pathways including a first water pathway extending around a first side of the toilet bowl and a second water pathway extending around a second side of the toilet bowl; and wherein the toilet bowl aperture and the auxiliary aperture are operable to permit the water to bypass the primary drain when the primary drain is clogged.

9. The toilet configuration of claim 8, further including a water supply fill valve within the water storage tank; and wherein the secondary drain, the toilet bowl aperture, the auxiliary aperture, the first water pathway, and the second water pathway are operable to permit the water to bypass the primary drain when the primary drain is clogged without overflowing the toilet bowl when the water supply fill valve is stuck in an open position.

* * * * *